US005600422A

United States Patent [19]

Fukami et al.

[11] Patent Number: 5,600,422

[45] Date of Patent: Feb. 4, 1997

[54] IMAGE-FORMING APPARATUS EMPLOYING A REVERSAL DEVELOPING SYSTEM

[75] Inventors: Toshiyuki Fukami; Masashi Tanaka; Masato Katsukawa; Hideo Nakamori, all of Osaka, Japan

[73] Assignee: Mita Industrial Co., Ltd., Osaka, Japan

[21] Appl. No.: 384,867

[22] Filed: Feb. 7, 1995

[30] Foreign Application Priority Data

Feb. 8, 1994 [JP] Japan ..... 6-014545

[51] Int. Cl.$^6$ ..... G03G 15/16

[52] U.S. Cl. ..... 399/313; 399/318; 399/159

[58] Field of Search ..... 355/271, 273, 355/274, 277

[56] References Cited

U.S. PATENT DOCUMENTS

| | | |
|---|---|---|
| 5,034,777 | 7/1991 | Ohzeki et al. . |
| 5,103,265 | 4/1992 | Kohyama . |
| 5,151,736 | 9/1992 | Ohzeki et al. . |
| 5,182,604 | 1/1993 | Asai . |
| 5,213,927 | 5/1993 | Kan et al. . |
| 5,235,386 | 8/1993 | Yano et al. . |
| 5,321,471 | 6/1994 | Ito et al. . |
| 5,386,279 | 1/1995 | Fukumi et al. . |

FOREIGN PATENT DOCUMENTS

| | | |
|---|---|---|
| 1200277 | 8/1989 | Japan . |

*Primary Examiner*—Matthew S. Smith
*Attorney, Agent, or Firm*—Sherman and Shalloway

[57] ABSTRACT

An image-forming apparatus employing a reversal developing system and using a photosensitive material capable of being charged into both positive and negative polarities and further using a transfer roller made of an electrically conducting sponge rubber. The photosensitive material and the transfer roller are press-contacted to each other with a suitable force, and a DC voltage is applied to the transfer roller, the DC voltage having a polarity opposite to the polarity of the potential created by the main charger and having a value larger than a charge start voltage of the photosensitive material but being so set that the potential on the surface of the photosensitive material after discharged is not larger than 50 V in an absolute value. This apparatus permits a toner image formed on the surface of the photosensitive material to be transferred at a high efficiency and enables the photosensitive material to be uniformly charged in a next cycle of forming image.

9 Claims, 5 Drawing Sheets

IMAGE-FORMING APPARATUS EMPLOYING A REVERSAL DEVELOPING SYSTEM

BACKGROUND OF THE INVENTION

1. Field of the Invention

The present invention relates to an image-forming apparatus employing a so-called reversal developing system. More specifically, the invention relates to an image-forming apparatus which employs a reversal developing system preventing the occurrence of image spots and featuring an improved transfer efficiency.

2. Description of the Prior Art

An image-forming apparatus employing a reversal developing system has heretofore been known. In this reversal developing system, a photosensitive material is uniformly charged into positive or negative polarity and is exposed to image-bearing light such as a laser beam or the like. Then, by attenuating the light, the portion irradiated with light corresponding to the document image is rendered to possess a residual potential of from 0 V to 100 V to form an electrostatic latent image. Then, a toner electrically charged to the same polarity as the polarity of the electrically charged photosensitive material is brought into contact with the photosensitive material followed by developing. The toner adhered onto the portions of potentials of from 0 V to 100 V on the surface of the photosensitive material is then transferred onto a transfer material such as paper or the like to form the image.

According to the above-mentioned image-forming method based on the reversal developing system, the toner image formed on the surface of the photosensitive material is transferred onto a paper or the like by using a transfer roller to which is applied a DC voltage of a polarity opposite to that of the toner image. In a step of transfer, therefore, there remains a problem in that the surface of the photosensitive material may be electrically charged into an opposite polarity, the electric charge will not be effectively discharged and the image may not be effectively formed.

In order to eliminate such a defect inherent in the image-forming apparatus employing the reversal developing system, Japanese Laid-Open Patent Publication No. 7086/1989 proposes means in which a DC voltage applied to the transfer roller is set to be smaller than a charge start voltage at which the photosensitive material is started to be electrically charged.

As a transfer roller to be used for such a transfer device, furthermore, Japanese Laid-Open Patent Publication No. 177063/1989 discloses the one which has a hardness of not larger than 30 degrees (JIS A). By using a transfer roller having a small hardness, this transfer device prevents the toner on the surface of the image carrier member from coagulating and enables the surface of the image carrier member to be easily cleaned.

Japanese Laid-Open Patent Publication No. 200277/1989 discloses a transfer system using a transfer roller similar to the one mentioned above, wherein an electric charge of a polarity opposite to that of the toner is fed to a transfer material such as a paper or the like in a state of maintaining a gap between the transfer material and an image carrier (photosensitive material), and the transfer material is then brought into contact with the image carrier.

According to means taught by the above-mentioned prior arts, however, only a DC voltage smaller than a charge start voltage is allowed to be applied to the transfer roller.

Therefore, the image is poorly transferred due to a decrease in the transfer efficiency and problems still remain for obtaining good images.

In the image-forming apparatus of the reversal developing system, on the other hand, when a voltage larger than a charge start voltage is applied to the transfer roller, the transfer roller is electrically charged to a polarity opposite to that of the main charge of the photosensitive material. The electric charge of this opposite polarity cannot be discharged in the discharging step that precedes the step of electrophotography. During the step of main charging, therefore, there develop portions having low potentials due to offset of the potential, resulting in the development of potential spots, i.e., image spots. The image spots are undesirable even in a line image and become particularly conspicuous in the case of a half-tone image.

The method using the transfer roller having a small rubber hardness is effective in preventing the photosensitive material from being worn out and in preventing the toner from coagulating. However, a decrease in the hardness of the rubber results in the occurrence of problems such as thermal deformation of the rubber and deformation due to heat and aging, making it difficult to maintain the contact between the transfer material and the photosensitive material constant at all times. When a gap larger than the thickness of the transfer material is provided between the transfer roller and the photosensitive material, the effect of transfer due to the surface state of the transfer roller surely decreases. However, the supply of current necessary for transferring the toner loses stability and the image becomes subject to be affected by environment such as humidity and the like.

SUMMARY OF THE INVENTION

The object of the present invention therefore is to provide an image-forming apparatus employing a reversal developing system capable of transferring a toner image formed on the surface of a photosensitive material at a high transfer efficiency and stably, discharging the electric charge effectively after the image has been formed, and uniformly charging the photosensitive material using a main charger in a subsequent cycle of image formation, in order to form a good image without image spots.

According to the present invention, there is provided an image-forming apparatus employing a reversal developing system and comprising a photosensitive material, a main charger, an image-exposing device, a reversal developing device, a transfer device and a discharger, wherein the transfer device comprises a transfer roller disposed near the surface of the photosensitive material and a power source for applying a DC voltage to said transfer roller, and wherein said photosensitive material is capable of being electrically charged into both positive and negative polarities, said transfer roller is an electrically conducting sponge roller that is brought into contact with the surface of the photosensitive material or is brought into pressed contact with the surface of the photosensitive material with a force which is not larger than 500 g/cm$^2$, a DC voltage applied to the transfer roller is of a polarity opposite to the polarity of the surface of the photosensitive material that is electrically charged by the main charger and has a value larger than a charge start voltage of the photosensitive material, and the potential on the surface of the photosensitive material after it is discharged is set to be not larger than 50 V in an absolute value.

Any photosensitive material can be used provided it is capable of being electrically charged into both positive and negative polarities. Generally, however, it is desired that the photosensitive material is an organic photosensitive material having a single dispersion-type photosensitive layer formed on an electrically conducting substrate, the photosensitive layer containing a charge-generating agent, an electron-transporting agent and a positive hole-transporting agent that are dispersed in a resin medium.

Any transfer roller can be used provided it is an electrically conducting sponge roller. Desirably, however, the roller should be made of a foamed polyurethane composition blended with an electrically conducting powder from the standpoint of electric properties and transfer properties.

In the present invention, the charge start voltage stands for a voltage applied to the transfer roller at a moment when the photosensitive material which is in contact with the transfer roller begins to acquire the surface potential as a result of gradually increasing the voltage applied to the transfer roller.

The diagrams A represent the cases of a photosensitive material capable of being electrically charged into one polarity only and the diagrams B represent the cases of a photosensitive material capable of being electrically charged into both positive and negative polarities.

Figure 4:
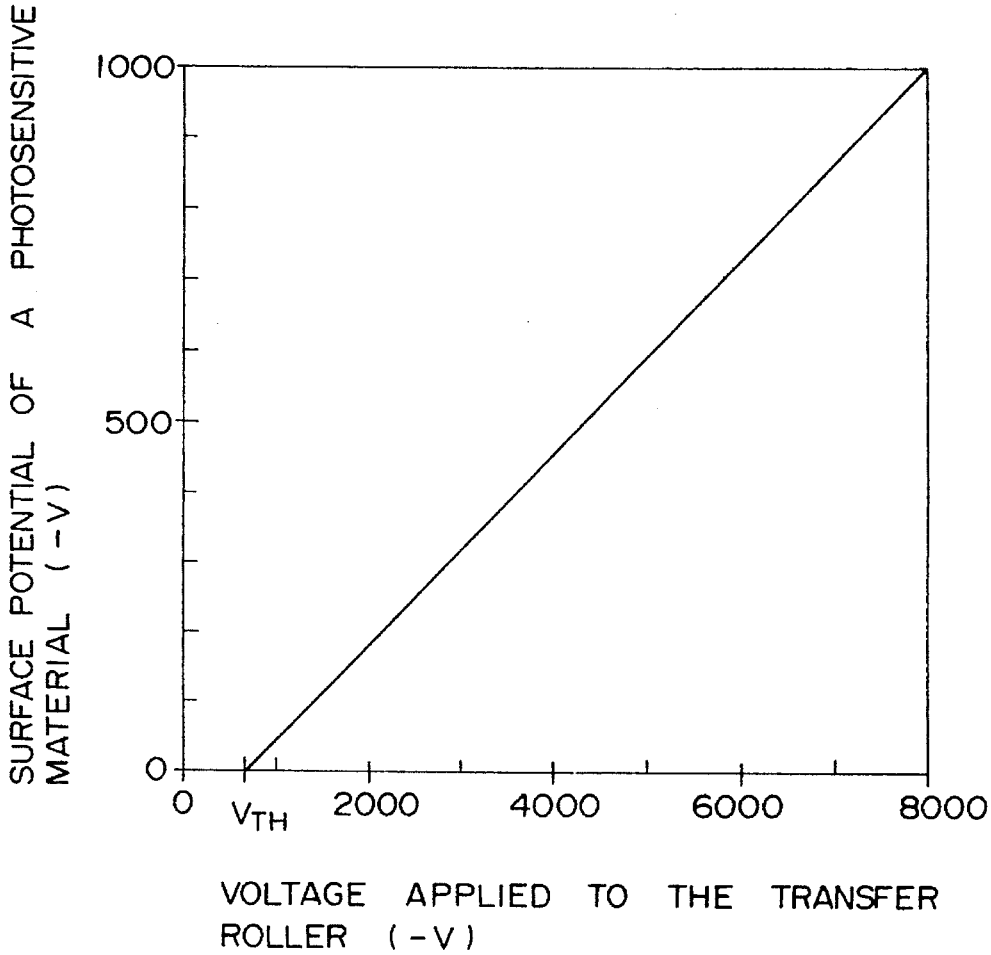
Figure 5:
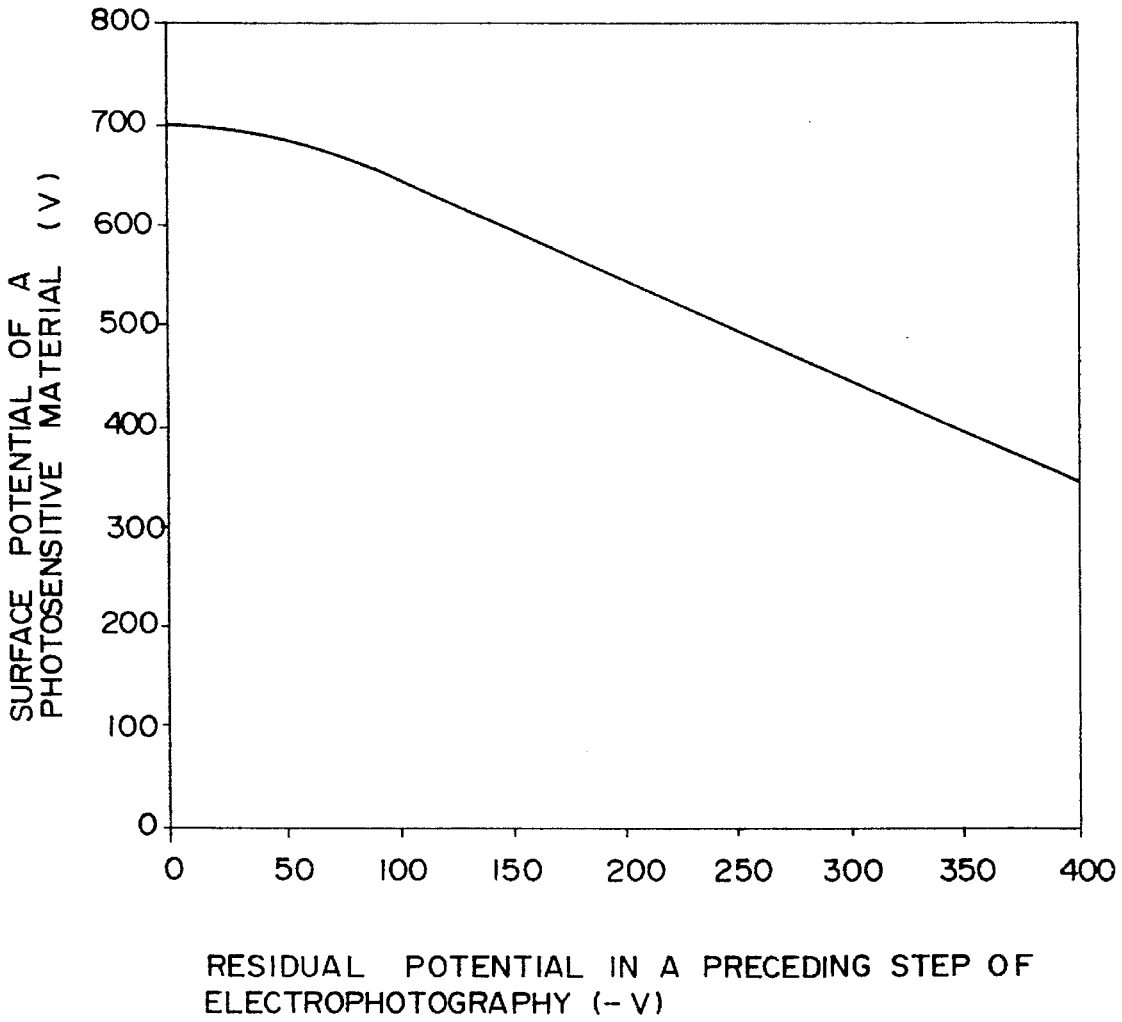
Figure 6:
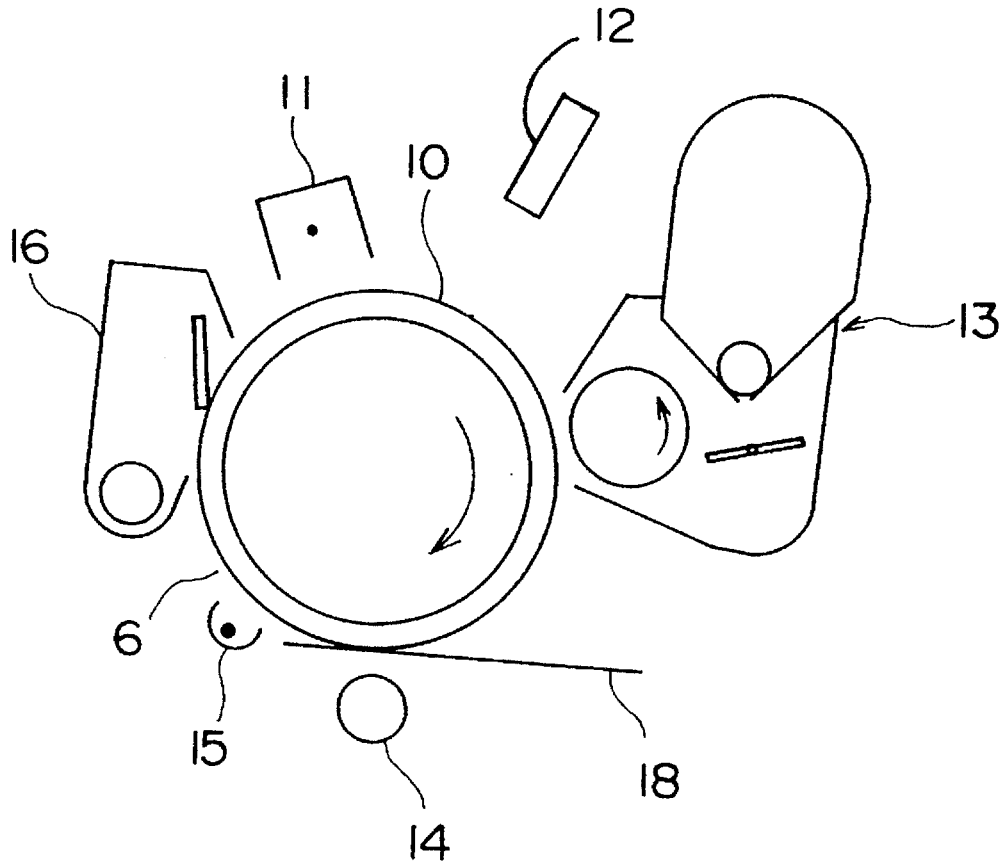
Figure 7:
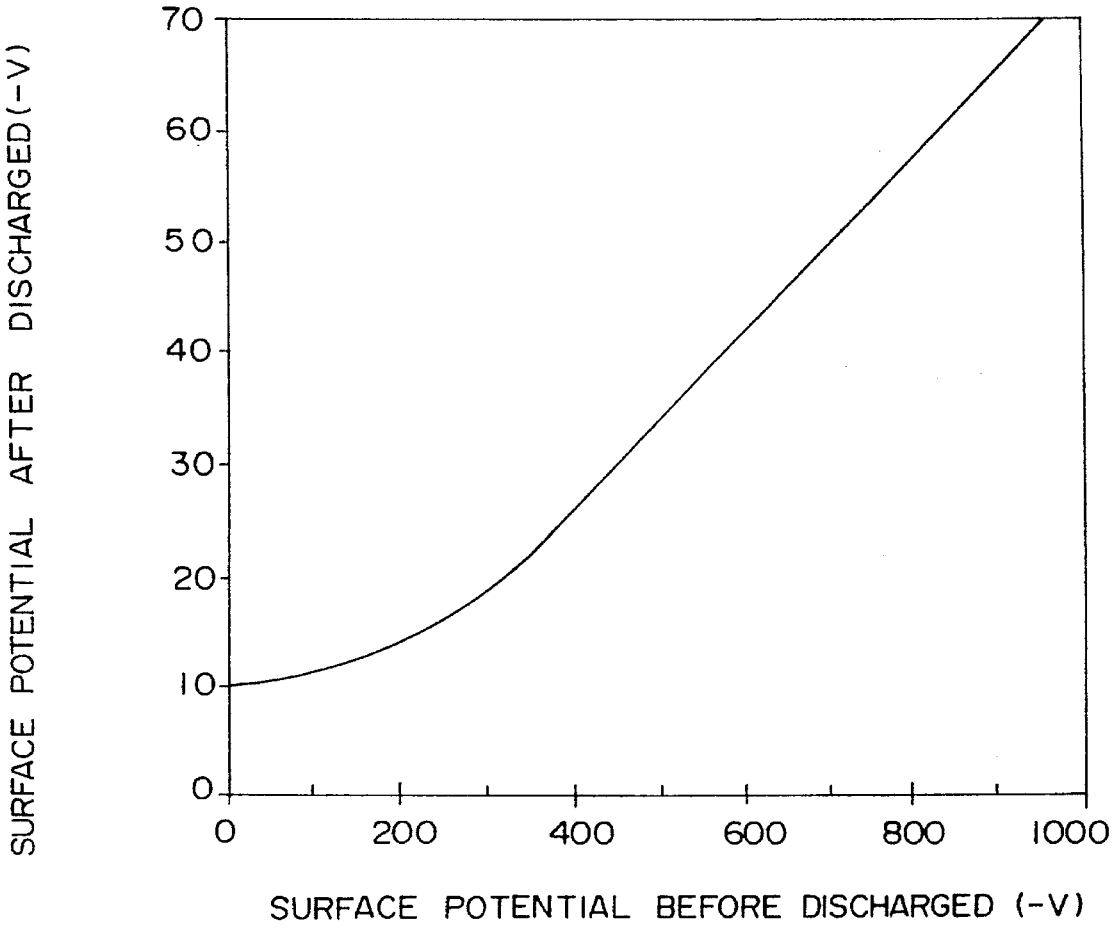

FIG. 4 is a diagram illustrating a relationship between the voltage applied to the transfer roller and the potential on the surface of the photosensitive material;

FIG. 5 is a diagram illustrating a relationship between the residual potential in the preceding step of electrophotography and the surface potential of when the main charging is effected maintaining a polarity opposite to that of the residual potential;

FIG. 6 is a diagram which schematically illustrates the arrangement of the image-forming apparatus of the present invention; and FIG. 7 is a diagram illustrating a relationship between the potential on the surface of the photosensitive material of before discharged and the potential on the surface of the photosensitive material after discharged.

DETAILED DESCRIPTION OF THE INVENTION

According to the present invention, an image-forming apparatus comprises a photosensitive material, a main charger, an image-exposing device, a reversal developing device, a transfer device and a discharger, the transfer device being provided with a transfer roller disposed near the surface of the photosensitive material. A toner image formed on the surface of a photosensitive material is transferred onto a transfer material by applying a DC voltage to the transfer roller at the time when the transfer material passes through between the transfer roller and the photosensitive material. Here, a distinguished feature resides in that use is made of a photosensitive material that is capable of being electrically charged into both positive and negative polarities, that the DC voltage applied to the transfer roller has a polarity opposite to the polarity on the surface of the photosensitive material charged by the main charger and has a value which is larger than a charge start voltage of the photosensitive material and that the potential on the surface of the photosensitive material after discharged is set to be not larger than 50 V in an absolute value.

In the field of electrophotography, a photosensitive material capable of being electrically charged into both positive and negative polarities stands for the one that is not only capable of being electrically charged into both positive and negative polarities but also permits the potential of the electric charge to be effectively decayed upon exposure to light irrespective of when it is positively charged or negatively charged.

Figure 1A:
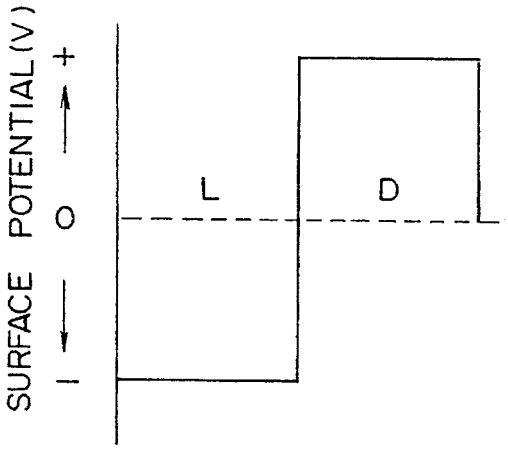
FIGS. 1A and 1B are diagrams illustrating distributions of residual potential of the photosensitive material after the toner image has been transferred.
Figure 1B:
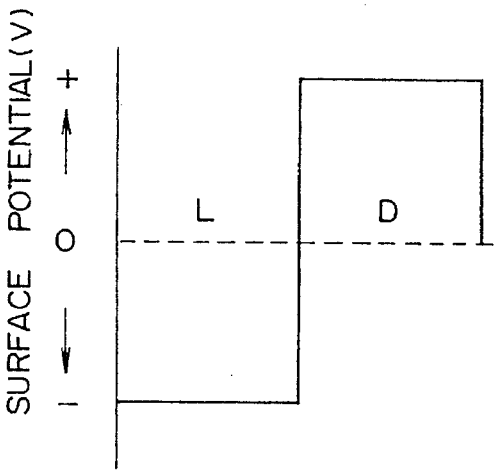
Figure 2A:
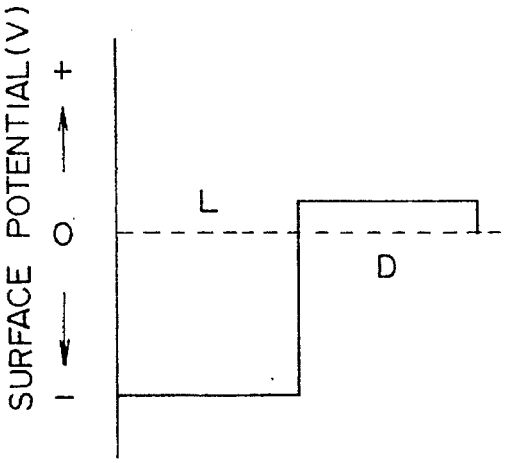
FIGS. 2A and 2B are diagrams illustrating distributions of residual potential after the photosensitive material is discharged.
Figure 2B:
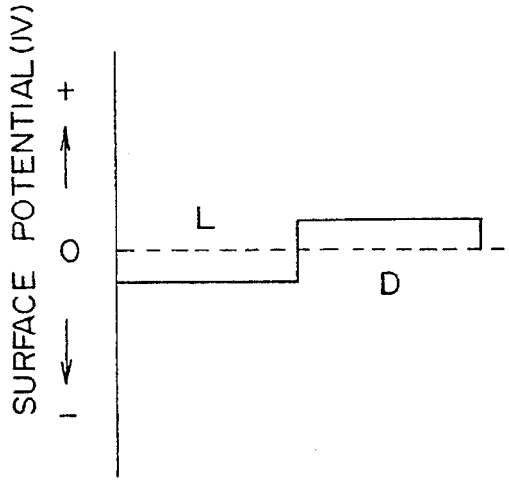
Figure 3A:
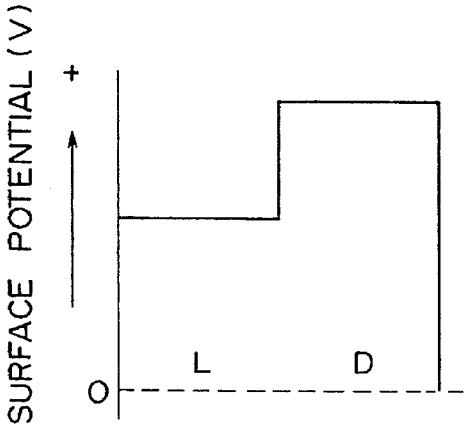
FIGS. 3A and 3B are diagrams illustrating distributions of surface potential after the photosensitive material is mainly charged.
Figure 3B:
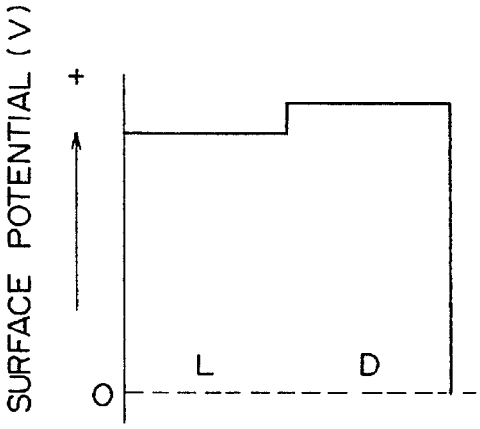

With reference to FIGS. 1A and 1B illustrating distributions of residual potential of the photosensitive material after the toner image has been transferred, FIGS. 2A and 2B illustrating distributions of residual potential after the photosensitive material is discharged and FIGS. 3A and 3B illustrating distributions of surface potential after the photosensitive material is mainly charged, the diagrams A represent the cases of a photosensitive material capable of being electrically charged into one polarity only and the diagrams B represent the cases of a photosensitive material capable of being electrically charged into both positive and negative polarities. For easy explanation, these diagrams deal with only the cases where the photosensitive material is mainly charged into positive polarity.

When a DC voltage applied to the transfer roller has a polarity (–) opposite to the polarity (+) of an electric charge fed by the main charger and has a value larger than a charge start voltage of a photosensitive material, the residual potential (FIG. 1) after the toner image is transferred assumes + in a dark portion D and assumes (–) in a bright portion L, which relation holds true in both the photosensitive materials A and B.

When these photosensitive materials are discharged (FIG. 2), however, the potential (+) greatly decreases in the dark portion D but the potential (–) decreases almost not at all in the bright portion L in the case of the photosensitive material A that is capable of being charged into one polarity (+) only. In the case of the photosensitive material B capable of being electrically charged into both positive and negative polarities, on the other hand, the potential + greatly decreases in the dark portion D and the potential – greatly decreases, too, in the bright portion L. This greatly affects the subsequent step of main charging.

When the photosensitive materials after discharged are subjected to the main charging (FIGS. 3A and 3B), in the case of the photosensitive material A which is capable of being electrically charged into one polarity (+) only the potential of the electric charge in the dark portion D remains normal as before but the potential of the electric charge in the bright portion L decrease is offset by the previous (–) potential (FIG. 2A). In the case of the photosensitive material B capable of being electrically charged into both positive and negative polarities, on the other hand, both the dark portion D and the bright portion L are nearly uniformly charged to a high potential, as compared to FIG. 3A, since the previous potential (–) in the FIG. 2B in the bright portion L has been greatly decreased.

Referring to FIG. 4 illustrating a relationship between the voltage applied to the transfer roller and the potential on the surface of the photosensitive material, the potential on the surface of the photosensitive material remains at nearly zero as far as the applied voltage is not larger than a charge start voltage ($V_{TH}$). In this case, however, the transfer efficiency of the toner decreases as a matter of course since the voltage applied to the transfer roller remains at a low level. According to the present invention, on the other hand, the voltage applied to the transfer roller is set to be larger than the charge start voltage ($V_{TH}$). Even when the surface of the photosensitive material assumes a large potential being electrically charged with the above voltage, the potential on the surface of the photosensitive material electrically charged by the transfer roller is decreased by means of electric discharge as explained with reference to FIGS. 1 to 3. Accordingly, the toner is transferred maintaining an increased efficiency without adversely affecting the uniformity in the electric charge in the step of main charging.

Referring to FIG. 5 illustrating a relationship between the residual potential in the preceding step of electrophotography and the surface potential of when the main charging is effected with a polarity opposite to that of the residual potential, the surface potential due to the main charging drops as a matter of course due to the offset effect caused by the residual potential. Here, the drop in the surface potential has almost no affect the uniformity in the image when the absolute value of the residual potential is smaller than 50 V and, particularly, smaller than 30 V. As the absolute value of the residual potential exceeds 50 V, however, the drop of the surface potential becomes no longer negligible, and the uniformity in the image is adversely affected.

According to the present invention, an electrically conducting sponge roller is used as a transfer roller and the toner image is transferred by bringing the electrically conducting sponge roller into contact with the photosensitive material or into pressed contact with the photosensitive material with a pressure of not larger than 500 g/cm$^2$, which is important from the standpoint of stably transferring the toner image maintaining a high transfer efficiency.

The transfer roller made up of a sponge roller rich in softness, cushioning property and flexibility can then be brought into contact with, or into pressed contact with, the surface of the photosensitive material while preventing the photosensitive material from being worn out or preventing the toner from coagulating on the surface of the photosensitive material. This makes it possible to reliably bring the transfer material such as the paper or the like into contact with the toner as well as to reliably and stably feed the transfer current.

When the transfer roller is separated away from the photosensitive material by a distance larger than the thickness of the transfer material, a transfer voltage of about 2500 V is usually required and, in addition, the current from the transfer roller is affected by the environment. With the electrically conducting sponge roller being disposed in contact with, or in pressed contact with, the photosensitive material, on the other hand, the toner can be transferred maintaining a good efficiency with a transfer voltage of about 800 to 1200 V as will be described later in Examples without affected by the environment such as humidity and the like.

It is particularly preferred that the electrically conducting sponge roller is made of a foamed polyurethane. When the electrically conducting sponge roller is brought into contact with, or pressed contact with, the photosensitive material, a variety of components blended in the rubber may bleed out to adversely affect the photosensitive material. In the case of the foamed polyurethane, however, the crosslinking and foaming are accomplished by the polymer itself or by the action of a chain extender; i.e., no component is contained that bleeds out and the photosensitive material is not deteriorated by the bleeding.

Besides, the polyurethane rubber exhibits a rubbery elasticity owing to the presence of soft segments based on polyester and polyether and hard segments based on an aromatic chain bonded via urethane or urea in the polymer chains. Therefore, the polyurethane rubber exhibits a high elastic recovering property, develops little permanent distortion over extended periods of time and exhibits excellent elastic properties. Besides, without containing ethylenical double bond in the polymer chains, the polyurethane rubber is little deteriorated by ozone, and further exhibits excellent electric properties such as without permitting the occurrence of leakage, discharge or pinholes even when a high voltage is applied thereto.

In the image-forming apparatus employing the reversal developing system according to the present invention, the electric charge is effectively discharged after the image has been formed, the photosensitive material is uniformly charged by the main charger even in a subsequent cycle of image formation, and a favorable image is obtained without image spots owing to the synergy of the above-mentioned actions. Accordingly, the toner image formed on the photosensitive material can be transferred at a high transfer efficiency.

[Image-Forming Apparatus]

Referring to FIG. 6 which schematically illustrates the image-forming apparatus of the present invention, a rotary photosensitive drum 6 equipped with the above-mentioned organic photosensitive layer 10 is surrounded by a corona charger 11 for main charging, an optical system 12 for exposure to image-bearing light equipped with a source of laser beam, a developing device 13, a transfer roller 14, a source of light 15 for discharging and a residual toner cleaning device 16.

To form an image, the photosensitive layer 10 of the photosensitive drum 6 is evenly charged into positive polarity or negative polarity by the corona charger 11. By this main charging, in general, the potential on the surface of the photosensitive layer 10 is set to lie within a range of from 500 to 700 V in an absolute value.

The photosensitive layer is then exposed to image-bearing light which is a laser beam from the optical system 12, whereby the potential becomes 0 V to 100 V in a portion of the photosensitive layer 10 corresponding to the image of the document (i.e., in a portion irradiated with the laser beam) and the potential in a portion (background) not irradiated with the laser beam is held at the dark decay potential from which the potential of the main charging is subtracted, thereby to form an electrostatic latent image.

The electrostatic latent image is developed by the developing device 13 and a toner image is formed on the surface of the photosensitive layer 10. Developing in the developing device 13 is carried out by a magnetic brush developing method or the like method by using a widely known developing agent such as a one-component-type developing agent or a two-component-type developing agent using a toner which is charged to the same polarity as the polarity of the main charge of the photosensitive layer 10. That is, on the portion irradiated with the laser beam is formed the toner image that is electrically charged to the same polarity as the polarity of the main charging. In this case, a bias voltage is applied across the developing device 13 and the photosensitive drum 6 to effectively carry out the developing in a customary manner.

The toner image formed on the surface of the photosensitive layer is transferred onto a transfer material such as a paper that passes through between the transfer roller 14 and the photosensitive drum 6. Thereafter, the electric charge in the photosensitive layer 10 is removed by being irradiated with light from the source of light for discharging 15.

[Photosensitive Material]

As the photosensitive material that can be electrically charged to both positive and negative polarities used in the present invention, there can be employed a variety kinds of photosensitive materials that have been known per se. According to the present invention in particular, it is desired to use an organic photosensitive material having a single dispersion-type organic photosensitive layer formed on an electrically conducting substrate, the organic photosensitive layer containing a charge-generating agent, an electron-transporting agent and a positive-hole transporting agent that are dispersed in a resin medium.

This photosensitive layer contains the charge-generating agent, electron-transporting agent and positive hole-transporting agent in a single layer, and is capable of being charged into both positive and negative polarities, suppresses the residual potential at a low level, and exhibits excellent sensitivity.

Examples of the charge-generating agent include selenium, selenium-tellurium, amorphous silicon, pyrylium salt, azo-type pigment, disazo-type pigment, anthanthrone-type pigment, phthalocyanine-type pigment, indigo-type pigment, threne-type pigment, toluidine-type pigment, pyrazoline-type pigment, perylene-type pigment, quinacridone-type pigment and the like, which may be used in a single kind or being mixed in two or more kinds so as to exhibit an absorption wavelength zone in a desired region.

Particularly preferred examples include an X-type metal-free phthalocyanine, an oxotitanyl phthalocyanine and a perylene-type pigment and, especially, those represented by the general formula (1),

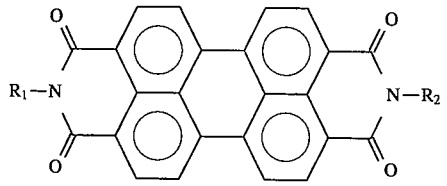

(1)

wherein $R_1$ and $R_2$ are alkyl groups, cycloalkyl groups, aryl groups, alkaryl groups or aralkyl groups, those groups may be substituted or unsybstituted and have not more than 18 carbon atoms.

Examples of the alkyl group include ethyl group, propyl group, buryl group, 2-ethyl hexyl group and the like groups, examples of the cycloalkyl group include cyclohexyl group and the like groups, examples of the aryl group include phenyl group, naphthyl group and the like groups, examples of the alkaryl group include tolyl group, xylyl group, ethyl phenyl group and the like groups, and examples of the aralkyl group include benzyl group, phenetyl group and the like groups. Examples of the substituent will be alkoxy group, halogen atom and the like.

A variety of resins can be used as a resin medium for dispersing the charge-generating agent. There can be used a variety of polymers, for instance, olefin-type polymers such as a styrene polymer, an acrylic polymer, a styrene/acrylic polymer, an ethylene/vinyl acetate copolymer, a polypropylene, an ionomer and the like; a polyvinyl chloride; a vinyl chloride/vinyl acetate copolymer; a polyester; an alkyd resin; a polyamide; a polyurethane, an epoxy resin; a polycarbonate; a polyarylate; a polysulfone; a diallyl phthalate resin; a silicone resin; a ketone resin; a polyvinyl butyral resin; a polyether resin; a phenolic resin; and a photo-curing resin such as an epoxy acrylate and the like. These binder resins can be used in a single kind or being mixed together in two or more kinds. Preferred examples of the resin include a styrene polymer, an acrylic polymer, a styrene/acrylic polymer, a polyester, an alkyd resin, a polycarbonate and a polyarylate.

Particularly preferred examples of the resin include a polycarbonate and the like and, especially, a polycarbonate derived from phosgenes and bisphenols represented by the following general formula (2),

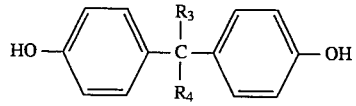

(2)

wherein $R_3$ and $R_4$ are hydrogen atoms or lower alkyl groups, and $R_3$ and $R_4$ being linked together may form a cyclic ring such as a cyclohexane ring together with a carbon atom that is bonded.

As the electron-transporting agent, any known electron-transporting agent can be used. Preferred examples include electron attractive substances such as a para-diphenoquinone derivative, benzoquinone derivative, naphthoquinone derivative, tetracyanoethylene, tetracyanoquinodimethane, chloroanil, bromoanil, 2,4,7-trinitro-9-fluorenone, 2,4,5,7-tetranitro-9-fluorenone, 2,4,7-trinitro-9-dicyanomethylene fluorenone, 2,4,5,7-tetranitroxanthone, and 2,4,8-trinitrothioxanthone, as well as these electron attractive substances which are rendered to have high molecular weights.

Among them, a para-diphenoquinone derivative and, particularly, an asymmetrical para-diphenoquinone derivative, is preferred because of its excellent solubility and excellent electron-transporting property.

As the para-diphenoquinone derivative, the one represented by the following general formula (3)

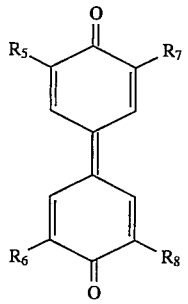

(3)

wherein $R_5$, $R_6$, $R_7$ and $R_8$ are hydrogen atoms, alkyl groups, cycloalkyl groups, aryl groups, aralkyl groups or alkoxy groups, is used. It is desired that $R_5$, $R_6$, $R_7$ and $R_8$ are substituents having an asymmetrical structure and that among $R_5$, $R_6$, $R_7$ and $R_8$, two of them are lower alkyl groups and the other two are branched alkyl groups, cycloalkyl groups, aryl groups or aralkyl groups.

Though not necessarily limited thereto only, preferred examples include 3,5-dimethyl-3',5'-di-t-butyldiphenoqunone,
3,5-dimethoxy-3',5'-di-t-butyldiphenoquinone,
3,3'-dimethyl-5,5'-di-t-butyldiphenoquinone, 3,5'-dimethyl-3',5-di-t-butyldiphenoquinone,
3,5,3',5'-tetramethyldiphenoquinone,
2,6,2',6'-tetra-t-butyldiphenoquinone,
3,5,3',5'-tetraphenyldiphenoquinone,
3,5,3',5'-tetracyclohexyldiphenoquinone and the like.

These diphenoquinone derivatives are desirable because of their small mutual action among the molecules due to their low molecular symmetry and because of their excellent solubility.

As the positive hole-transporting substance, the following compounds have been known. Among them, the compounds having excellent solubility and positive hole-transporting property are used. That is, there can be used:

pyrene;
N-ethylcarbazole;
N-isopropylcarbazole;
hydrazone salts such as,

N-methyl-N-phenylhydrazino-3-methylidene-9-carbazole,
N,N-diphenylhydrazino-3-methylidene-9-ethylcarbazole,
N,N-diphenylhydrazino-3-methylidene-10-ethylphenothiazine.
N,N-diphenylhydrazino-3-methylidene-10-ethyl phenoxazine,
p-diethylaminobenzaldehyde-N,N-diphenylhydrazone,
p-diethylaminobenzaldehyde-α-naphthyl-N-phenylhydrazone,
p-pyrrolidinobenzaldehyde-N,N-diphenylhydrazone,
1,3,3-trimethylindolenine-ω-aldehyde-N,N-diphenylhydrazone, and
p-diethylbenzaldehyde-3-methylbenzthiazolinone-2-hydrazone;
2,5-bis(p-diethylaminophenyl)-1,3,4-oxadiazole;
pyrazolines such as, 1-phenyl-3-(p-diethylaminostyryl)-5-(p-diethylaminophenyl)pyrazoline,
1-[quinonil(2)]-3-(p-diethylaminostyryl)-5-(p-diethylaminophenyl)pyrazoline,
1-[pyridyl(2)]-3-(p-diethylaminostyryl)-5-(p-diethylaminophenyl)pyrazoline,
1-[6-methoxy-pyridyl(2)]-3-(p-diethylaminostyryl)-5-(p-diethylaminophenyl)pyrazoline,
1-[pyridyl(3)]-3-(p-diethylaminostyryl)-5-(p-diethylaminophenyl)pyrazoline,
1-[lepidyl(3)]-3-(p-diethylaminostyryl)-5-(p-diethylaminophenyl)pyrazoline,
1-[pyridyl(2)]-3-(p-diethylaminostyryl)-4-methyl-5-(p-diethylaminophenyl)pyrazoline,
1-[pyridyl(2)]-3-(α-methyl-p-diethylaminostyryl)-3-(p-diethylaminophenyl)pyrazoline, and
1-phenyl-3-(p-diethylaminostyryl)-4-methyl-5-(p-diethylaminophenyl)pyrazoline;
oxazole-type compounds such as.

2-(p-diethylaminostyryl)-3-diethylaminobenzoxazole, and
2-(p-diethylaminophenyl)-4-(p-dimethylaminophenyl)-5-(2-chlorophenyl)oxazole;
a triaryl methane-type compound such as bis(4-diethylamino-2-methylphenyl)phenylmethane;
polyaryl alkanes such as, 1,1-bis(4-N,N-diethylamino-2-methylphenyl)heptane, and
1,1,2,2-tetrakis(4-N,N-dimethylamino-2-methylphenyl)ethane;
benzidine compounds such as, N,N'-diphenyl-N,N'-bis(methylphenyl)benzidine,
N,N'-diphenyl-N,N'-bis(ethylphenyl)benzidine,
N,N'-diphenyl-N,N'-bis(propylphenyl)benzidine,
N,N'-diphenyl-N,N'-bis(butylphenyl)benzidine,
N,N'-bis(isopropylphenyl)benzidine,
N,N'-diphenyl-N,N'-bis(secondary butylphenyl)benzidine,
N,N'-diphenyl-N,N'-bis(tertiary butylphenyl)benzidine,
N,N'-diphenyl-N,N'-bis(2,4-dimethylphenyl)benzidine, and
N,N'-diphenyl-N,N'-bis(chlorophenyl)benzidine;
triphenylamine;
poly-N-vinylcarbazole;
polyvinyl pyrene;
polyvinyl anthracene;
polyvinyl acridine;
poly-9-vinylphenyl anthracene;
pyrene-formaldehyde resin; and
ethylcarbazolformaldehyde resin.

Among them, preferably used are benzidine-type transporting agents and, particularly, a transporting agent represented by the general formula (4)

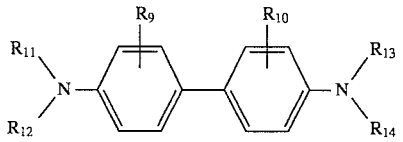

(4)

wherein $R_9$ and $R_{10}$ are lower alkyl groups such as methyl groups or ethyl groups, and $R_{11}$, $R_{12}$, $R_{13}$ and $R_{14}$ are alkyl groups having not more than 18 carbon atoms, cycloalkyl groups, aryl groups, alkaryl groups or aralkyl groups, and carbazole hydrazone-type transporting agents and, particularly, a transporting agent represented by the general formula (5)

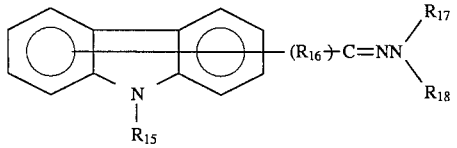

(5)

wherein $R_{15}$ is a hydrogen atom, an alkyl group or an acyl group, $R_{16}$ is a divalent organic group such as an alkylene group, and $R_{17}$ and $R_{18}$ have not more than 18 carbon atoms, and are alkyl groups, cycloalkyl groups, aryl groups, alkaryl groups or aralkyl groups, because of their good solubility and positive hole-transporting property.

In the single dispersion-type photosensitive material used in the present invention, it is desired that the charge-generating agent (CGM) is contained in the photosensitive layer in an amount of from 0.1 to 5% by weight and, particularly, from 0.25 to 2.5% by weight per the solid component, the electron-transporting agent is contained in the photosensitive layer in an amount of from 5 to 50% by weight and, particularly, from 10 to 40% by weight per the solid component and that the positive hole-transporting agent is contained in the photosensitive layer in an amount of from 5 to 50% by weight and, particularly, from 10 to 40% by weight per the solid component. In this case, it is most desired that the electron-transporting agent and the positive hole-transporting agent are contained at a weight ratio of from 1:9 to 9:1 and, particularly, from 2:8 to 8:2.

The composition for forming the photosensitive layer used in the present invention may be blended with a variety of widely known blending agents such as an antioxidizing agent, a radical trapping agent, a singlet quencher, a UV-absorbing agent, a softening agent, a surface reforming agent, a defoaming agent, a filler, a viscosity-increasing agent, a dispersion stabilizer, a wax, an acceptor, a donor and the like in amounts that will not adversely affect the electrophotographic properties.

By blending a steric hindrance phenolic antioxidizing agent in an amount of from 0.1 to 50% by weight per the whole solid components, furthermore, it is allowed to markedly improve the durability of the photosensitive layer without adversely affecting the electrophotographic properties.

As the electrically conducting substrate for providing the photosensitive layer, a variety of materials having electrically conducting property can be used. For instance, there can be used metals such as aluminum, copper, tin, platinum, gold, silver, vanadium, molybdenum, chromium, cadmium, titanium, nickel, indium, a stainless steel and a brass; a plastic material on which the above-mentioned metals are deposited or laminated; and a glass covered with an aluminum iodide, a tin oxide or an indium oxide.

The photosensitive material of the single layer dispersion type used in the present invention usually employs an ordinary aluminum blank tube and, particularly, a blank tube treated with alumite such that the thickness of the film is from 1 to 50 μm since it does not develop interference fringes.

The single dispersion layer-type photosensitive material is formed by preparing the charge-generating material, charge-transporting agent and binder resin by using a widely known method such as a roll mill, a ball mill, Attritor, a paint shaker or an ultrasonic wave dispersing machine, and by applying the mixture relying upon a widely known application means, followed by drying.

Though there is no particular limitation, it is desired that the thickness of the photosensitive layer is generally from 5 to 100 μm and, particularly, from 10 to 50 μm.

As the solvent for obtaining a coating solution, there can be used a variety of organic solvents. Examples include alcohols such as methanol, ethanol, isopropanol, butanol and the like; aliphatic hydrocarbons such as n-hexane, octane, cyclohexane and the like; aromatic hydrocarbons such as benzene, toluene, xylene and the like; halogenated hydrocarbons such as dichloromethane, dichloroethane, carbon tetrachloride, chlorobenzene and the like; ethers such as dimethyl ether, diethyl ether, tetrahydrofurane, ethylene glycol dimethyl ether, diethylene glycol dimethyl ether and the like; ketones such as acetone, methyl ethyl ketone, cyclohexanone and the like; esters such as ethyl acetate, methyl acetate and the like; dimethylformamide; and dimethyl sulfoxide, which may be used in one kind or being mixed together in two or more kinds. The concentration of the solid component in the coating solution should generally be from 5 to 50%.

[Transfer Roller]

As the transfer roller 14, use is made of a foamed product of an elastomer polymer blended with an electrically conducting powder that is formed into a roller. It is desired that the volume resistivity of the electrically conducting rubber is usually from $10^7$ to $10^{14}$ Ωcm, and the surface hardness is from 30° to 70° in compliance with JISC.

As the elastomer polymer, there can be used, for example, a nitrile/butadiene rubber (NBR), a styrene/butadiene rubber (SBR), a chloroprene rubber (CR), a polybutadiene (BR), a polyisoprene (IIB), a butyl rubber, a natural rubber, an ethylene/propylene rubber (EPR), an ethylene/propylene/diene rubber (EPDM), a polyurethane, a polyethylene chloride, a polypropylene chloride, and a soft vinyl chloride resin.

As the electrically conducting powder, there can be used an electrically conducting carbon black, a tin oxide doped with indium or antimony, or a metal powder such as of copper, silver or aluminum. Among them, it is desired to use the electrically conducting carbon black. It is desired that the electrically conducting powder is contained in an amount of from 5 to 70% by weight and, particularly, from 10 to 50% by weight per the whole amount.

As the foaming agent, there can be used an inorganic foaming agent such as sodium hydrogencarbonate, sodium carbonate, ammonium hydrogencarbonate, ammonium carbonate or ammonium nitrite; a nitroso compound such as an N,N'-dimethyl-N,N'-dinitrosoterephthalamide or an N,N'-dinitrosopentamethylenetetramine; an azo compound such as an azodicarbonamide, an azobisisobutylonitrile, an azocyclohexylnitrile, an azodiaminobenzene, or a barium azodicarboxylate; a sulfonyl hydrazide compound such as a benzenesulfonyl hydrazide, a toluenesulfonyl hydrazide, a p,p'-oxybis(benzenesulfonyl hydrazide), or a diphenylsulfone-3,3'-disulfonyl hydrazide; and an azide compound such as a calcium azide, a 4,4'-diphenyldisulfonyl azide, or a p-toluenesulfonyl azide. In particular, a nitroso compound, an azo compound and an azide compound are desirably used.

These foaming agents are blended at a ratio of from 1 to 30 parts by weight and, preferably, from 2 to 20 parts by weight per 100 g of the rubber.

A foaming assistant that can be used together with the foaming agent may be an organic acid such as salicylic acid, phthalic acid or stearic acid, or urea or a derivative thereof, which works to lower the decomposition temperature of the foaming agent, promotes the decomposition and uniformalizes the foaming.

In forming the electrically conducting rubber roller, there can be blended widely known blending agents such as a sulfur-type or organic-type vulcanizing agent, a vulcanization-promoting agent, a softening agent, an anti-aging agent, a filler, a dispersing agent and a plasticizer.

In a preferred embodiment of the present invention, the transfer roller 14 is formed of a foamed polyurethane composition blended with an electrically conducting powder.

The urethane rubber used for the transfer roller is obtained by reacting a chain extender (crosslinking agent) with a polyurethane prepolymer (isocyanate-terminated polymer) that is obtained by the reaction of a polyol (hydroxyl group-terminated polymer) with a polyisocyanate compound. The urethane rubber, when it is of a linear structure, has recurring units represented by the following formula (6), $$\left(YR_3\underset{\underset{O}{\|}}{C}\right)_m NH\left[R_1NH\underset{\underset{O}{\|}}{C}OR_2O\underset{\underset{O}{\|}}{C}NH\right]_n R_1NHC- \quad (6)$$

wherein $R_1$ is a polyol residue, $R_2$ is a polyisocyanate residue, $R_3$ is a residue of a chain extender, Y is an —O— group or an —NR— group (R is a hydrogen atom or a monovalent organic group), m is zero or 1, and n is a number of 1 or larger.

In the recurring units represented by the above formula (6), the polyol residue $R_1$ is a soft segment and the polyisocyanate residue $R_2$ is a hard segment. When the chain extender (crosslinking agent) is water (which may also serve as a foaming agent), m becomes zero due to the decarboxylation reaction. When the chain extender is a low molecular diol or diamine, m becomes 1.

The polyurethane is formed by the reaction of an isocyanate-terminated prepolymer represented by the following formula (7)

$$OCN+R_1NHC\underset{\underset{O}{\|}}{O}R_2O\underset{\underset{O}{\|}}{C}NH\frac{}{n}R_1-NCO \quad (7)$$

with a chain extender of the following formula (8)

$$HYR_3YH \quad (8)$$

and water (which works both as a foaming agent and as a crosslinking agent). By adjusting this reaction, it is allowed to obtain a sponge rubber having a desired foaming degree and a desired crosslinking degree.

That is, the free isocyanate group in the prepolymer reacts with the chain extender (crosslinking agent) to form a urea bond which helps increase the molecular weight of the polyurethane, and further reacts with the urethane bond that is existing already and with the urea bond to form allophanate bond and buret bond that help form a three-dimensional crosslinked structure resulting in an increase in the rubber hardness, abrasion resistance, heat resistance and durability. At the same time, the water that is used gives rise to the occurrence of decarboxylation reaction at the time of crosslinking and the carbonic acid gas brings about the foaming in the polyurethane, which is very desirable.

As the polyol used for forming the prepolymer, there is used a polyol having two or more and, preferably, two to three active hydrogen atoms in one molecule, such as a polyether polyol, polyester polyol, polyacrylic polyol, and a polyvinyl polyol which may be used in one kind or in two or more kinds. It is desired to use the polyester polyol from the standpoint of electric properties and durability, and the widely known polyester polyol used in the production of polyester polyurethane is employed in the present invention.

Among them, the preferred polyester polyol comprises a diol and a dicarboxylic acid, and is obtained by suitably reacting at least one of aliphatic diols with at least one of aliphatic carboxylic acids. Moreover, the polyester polyol may contain, for example, a polyester component that is obtained by the ring opening polymerization of the polycaprolactam.

Preferred examples of the aliphatic diol component include 1,2-propanediol, 1,3-propanediol, 1,3-butanediol, 1,4-butanediol, 1,5-pentanediol, 1,6-hexanediol, 1,8-octanediol, 1,10-decanediol, neopentyl glycol, ethylene glycol, diethylene glycol, polyethylene glycol, dipropylene glycol, polypropylene glycol, 1,4-cyclohexanemethanol, 1,4-cyclohexanediol, 3-methyl-1,5-pentanediol and the like.

Preferred examples of the aliphatic carboxylic acid include malonic acid, succinic acid, glutaric acid, adipic acid, pimelic acid, suberic acid, azelaic acid, sebacic acid, decanedicarboxylic acid, dodecanedicarboxylic acid, 1,3-cyclohexanedicarboxylic acid, and 1,4-cyclohexanedicarboxylic acid.

It is desired that the hydroxyl group-terminated polymer has a number average molecular weight of from 300 to 10000 and, particularly, from 1000 to 8000.

As the polyisocyanate compound, there can be used any known polyisocyanate compound that is used for the preparation of a polyurethane. Among them, it is desired to use a diisocyanate such as tolylenediisocyanate, 4,4-diphenylmethanediisocyanate, xylylenediisocyanate, naphthylenediisocyanate, paraphenylenediisocyanate, tetramethylxylenediisocyanate, hexamethylenediisocyanate, dicyclohexylmethanediisocyanate, isophoronediisocyanate, and tolidinediisocyanate. Particularly preferred examples include the 4,4-diphenylmethane diisocyanate, xylylene diisocyanate, isophorone diisocyanate and hexamethylene diisocyanate.

The polyurethane prepolymer is prepared by blending one or two or more kinds of polyols and one or two or more kinds of polyisocyanate compounds at an NCO/OH ratio of from 1.1 to 4 and, more preferably, from 1.3 to 2.5, and reacting them together at a temperature of 60° to 130° C. for several hours.

As the chain extender(crosslinking agent), there can be used polyfunctional active hydrogen-containing compounds and, particularly, low molecular polyols, and low molecular polyamines, particularly, aliphatic to aromatic polyamines. Use is further made of the water that serves as the foaming agent as well as the crosslinking agent.

It is desired that the chain extender such as polyols is used in an amount of from 1 to 30 parts by weight and, particularly, from 3 to 15 parts by weight per 100 parts by weight of the prepolymer and the water is used in an amount of from 1 to 30 parts by weight and, particularly, from 2 to 20 parts by weight per 100 parts by weight of the prepolymer.

Preferred examples or, the chain extender (crosslinking agent) include aliphatic diol components such as 1,2-propanediol, 1,3-propanediol, 1,3-butanediol, 1,4-butanediol, 1,5-pentanediol, 1,6-hexanediol, 1,8-octanediol, 1,10-decanediol, neopentyl glycol, ethylene glycol, diethylene glycol, polyethylene glycol, dipropylene glycol, polypropylene glycol, 1,4-cyclohexane methanol, 1,4-cyclohexanediol, 3-methyl-1,5-pentanediol and the like.

Preferred examples of the aliphatic diamine component include 1,2-propanediamine, 1,3-propanediamine, 1,3-butanediamine, 1,4-butanediamine, 1,5-pentanediamine, 1,6-hexanediamine, 1,8-octanediamine, 1,10-decanediamine, neopentyldiamine, ethylenediamine, 1,4-cyclohexanediamine, 3-methyl-1,5-pentanediamine and the like.

Preferred examples of the aromatic polyamine include tolylenediamine, 4,4'-diphenylmethanediamine, xylylenediamine, naphthylenediamine, paraphenylenediamine, tetramethylxylenediamine, dicyclohexylmethanediamine, isophoronediamine and tolidinediamine.

The chain-extending (crosslinking) and foaming reaction is carried out at such temperatures and for such periods of time that there is obtained a polyurethane having a desired foaming multiplication and a desired crosslinking degree, the reaction temperature and the reaction time usually ranging from 100° to 300° C. and from 1 to 7 hours.

The electrically conducting powder is blended in the composition of the prepolymer and the chain extender (crosslinking agent) prior to effecting the crosslinking so as to be evenly and homogeneously blended and dispersed.

[Transfer Condition]

To transfer the toner image, a DC voltage is applied to the transfer roller 14, the DC voltage having a polarity opposite to the polarity of main electric charge in the photosensitive layer 10 and having a value higher than a charge start voltage of the photosensitive material. In the case of the single dispersion layer-type organic photosensitive material that is desirably used in the present invention, the charge 7 start voltage ($V_{TH}$) of the photosensitive material is from about 0.3 to about 1.0 KV though it may vary depending upon the kind of the photosensitive material. The application voltage that is desired from the standpoint of toner transfer efficiency is 1.1 times or more as large as, and, particularly, 1.5 times or more as large as, the charge start voltage ($V_{TH}$) of the photosensitive material.

The upper limit of the voltage applied to the transfer roller is determined by the potential on the surface of the photosensitive layer 10 after it is discharged (determined by the residual potential before effecting the main charging). That is, the application voltage should be so set that the residual potential of before effecting the main charging is not larger than 50 V and, preferably, not larger than 20 V in an absolute value.

FIG. 7 illustrates a relationship between the potential on the surface of the photosensitive material of before discharged (surface potential after the image is transferred) and the potential on the surface of the photosensitive material after discharged. The application voltage can be set relying upon this curve so as to satisfy the above-mentioned conditions.

According to the present invention which uses a photosensitive material that is capable of being electrically charged into both positive and negative polarities as mentioned already, it is allowed to uniformly effect the main charging in the next cycle of image formation even when the surface potential after discharged has a polarity opposite to that of main charging provided it does not depart from the above-mentioned range. It is therefore made possible to obtain an image without shading even from a half-tone document. This, in other words, means that the DC voltage (absolute value) applied to the transfer roller 14 is set to be larger than that of the conventional systems in order to improve the toner transfer efficiency.

After the toner is transferred and the electric charge is discharged, the toner remaining on the photosensitive layer 10 is removed by the cleaning device 16, and the next cycle is carried out for forming the image. As required, furthermore, the toner image transferred onto the transfer material is fixed onto the transfer material such as the paper by the application of heat or pressure.

EXAMPLES

The invention will now be described by way of Examples.

[Preparation of Transfer Roller]

A mixture of 100 parts by weight of a polyethylene glycol adipate (average molecular weight of 1820) and 18 parts by weight of a naphthalene-1,5-diisocyanate was stirred at 80° C. for 2 hours to prepare an isocyanate-terminated prepolymer.

The following composition was prepared:

| | |
|---|---|
| Above-mentioned prepolymer | 100 parts by weight |
| 1,4-Butanediol (crosslinking agent) | 5 parts by weight |
| Water (crosslinking agent and foaming agent) | 5 parts by weight |
| Dibutyltin dilaurate (catalyst) | 0.005 parts by weight |
| Carbon black (conducting agent) | 20 parts by weight |

The above components were mixed together to a sufficient degree, poured into a mold in which is inserted an electrically conducting core, and polymerized at 150° C. for 4 hours followed by aging to form a transfer roller 15 mm in diameter.

[Preparation of Photosensitive Materials]

Photosensitive material of the type that can be charged into both polarities (α).

| | |
|---|---|
| X-type metal-free phthalocyanine (charge-generating agent) | 5 parts by weight |
| N,N'-Bis(o,p-dimethylphenyl)-N,N'-diphenylbenzidine (positive hole-transporting agent) | 40 parts by weight |
| 3,3'-5,5'-Tetraphenyl-diphenoquinone (electron-transporting agent) | 40 parts by weight |
| Polycarbonate (binder resin) | 100 parts by weight |
| Dichloromethane (solvent) | 800 parts by weight |

The above-mentioned components were mixed and dispersed by using a paint shaker to prepare a coating solution, which was then applied onto an aluminum blank tube followed by drying with the hot air heated at 60° C. for 60 minutes to prepare an organic photosensitive drum (α) of the type that can be electrically changed into both polarities having a film thickness of 15 μm.

The photosensitive material exhibited a charge start voltage of 0.56 KV when it was charged into the positive polarity and 0.52 KV when it was charged into the negative polarity.

Photosensitive material of the type that can be charged into positive polarity (β).

| | |
|---|---|
| CTL (Charge-transporting layer) | |
| N,N'-Bis(o,p-dimethylphenyl)-N,N'-diphenylbenzidine (positive hole-transporting agent) | 80 parts by weight |
| Polycarbonate (binder resin) | 100 parts by weight |
| Dichloromethane (solvent) | 800 parts by weight |
| CGL (Charge-generating layer) | |
| X-type metal-free phthalocyanine (charge-generating agent) | 80 parts by weight |
| Polyvinyl butyral (binder resin) | 100 parts by weight |
| n-Butyl alcohol (solvent) | 800 parts by weight |

The above CTL components were mixed and dispersed by using a roll mill to prepare a coating solution, which was then applied onto an aluminum blank tube followed by drying with the hot air heated at 60° C. for 40 minutes to obtain a CTL having a film thickness of 15 μm. Next, the above CGL components were mixed and dispersed by using the paint shaker to prepare a coating solution which was then applied onto the CTL in such an amount that the thickness of the CGL film after drying was 2 μm, followed by drying with the hot air heated at 120° C. for 15 minutes to prepare an organic photosensitive drum of the type that can be charged into positive polarity (β).

The photosensitive material exhibited a charge start voltage of 0.52 KV when it was charged into positive polarity.

Examples 1–2 and Comparative Examples 1–3

The above-mentioned photosensitive drum and the transfer roller (having a sponge hardness of 45° in compliance with JIS C) were fitted to an image-forming apparatus shown in FIG. 6, the press-contacting force between the photosensitive drum and the transfer roller was adjusted as tabulated below, and a two-component-type developing agent containing a positively charged toner was used.

In this apparatus, the surface of the photosensitive layer was evenly charged to +700 V by the main charger, exposed to image-bearing light, and then a developing bias voltage of +350 V was applied thereto to effect the reversal developing.

Then, the transfer was effected by changing the DC voltage of negative polarity that was applied to the transfer roller in order to measure the potential on the surface of the photosensitive layer after discharged, to measure the degree of shading in the half-tone image and to measure the transfer efficiency of the toner image. The results were as shown in Table 1.

TABLE 1

| Run No. | Photo-sensitive material | Press-contacting force of transfer roller to photo-sensitive roller | Voltage applied to transfer roller | Surface potential after dis-charged (Max) | Density shading of half-tone *1 | Transfer efficieney |
|---|---|---|---|---|---|---|
| Example 1 | α | 320 g/cm$^2$ | −1200 V | −49V | 3.1% | 92% |
| Example 2 | α | 320 g/cm$^2$ | −800 V | −19V | 2.1% | 85% |
| Comp. Ex. 1 | α | 320 g/cm$^2$ | −1300 V | −57V | 3.6% | 93% |
| Comp. Ex. 2 | α | 320 g/cm$^2$ | −500 V | −10V | 1.7% | 73% |
| Comp. Ex. 3 | β | 320 g/cm$^2$ | −800 V | −280V | 10.3% | 83% |

*1: Density shading of half-tone is given by $(ID_{MAX} - ID_{MIN})/ID_{AVE} \times 100$
where $ID_{MAX}$: a maximum measured value of half-tone image density,
$ID_{MIN}$: a minimum measured value of half-tone image density,
$ID_{AVE}$: an average measured value of half-tone image density.

We claim:

1. An image-forming apparatus employing a reversal developing system and comprising a photosensitive material, a main charger, an image-exposing device, a reversal developing device, a transfer device and a discharger, wherein the transfer device comprises a transfer roller disposed near the surface of the photosensitive material and a power source for applying a DC voltage to said transfer roller, and wherein said photosensitive material is capable of being electrically charged into both positive and negative polarities, said transfer roller is an electrically conducting sponge roller that is brought into contact with the surface of the photosensitive material or is brought into pressed contact with the surface of the photosensitive material with a force which is not larger than 500 g/cm$^2$ a DC voltage applied to the transfer roller is of a polarity opposite to the polarity of the surface of the photosensitive material that is electrically charged by the main charger and has a value larger than a charge start voltage of the photosensitive material, and the potential on the surface of the photosensitive material after it is discharged is set to be not larger than 50 V in an absolute value.

2. An image-forming apparatus according to claim 1, wherein the photosensitive material is an organic photosensitive material having a single dispersion type photosensitive layer formed on an electrically conducting substrate, and the photosensitive layer contains a charge-generating agent, an electron-transporting agent and a positive hole-transporting agent dispersed in a resin medium.

3. An image-forming apparatus according to claim 1, wherein the photosensitive material has a charge start voltage of from 300 V to 2000 V.

4. An image-forming apparatus according to claim 1, wherein the transfer roller is impressed with a voltage which is 1.5 times or more as great as the charge start voltage.

5. An image-forming apparatus according to claim 1, wherein the transfer roller is made of a foamed polyurethane composition blended with an electrically conducting powder.

6. An image-forming apparatus employing a reversal developing system and comprising a photosensitive material, a main charger, an image-exposing device, a reversal developing device, a transfer device and a discharger, wherein the transfer device comprises a transfer roller disposed near the surface of the photosensitive material and a power source for applying a DC voltage to said transfer roller, and wherein said photosensitive material is an organic photosensitive material having a single dispersion type photosensitive layer formed on an electrically conducting substrate, and the photosensitive layer contains a charge-generating agent, an electron-transporting agent and a positive hole-transporting agent dispersed in a resin medium and has a charge start voltage of from 300 V to 2000 V, and is capable of being electrically charged into both positive and negative polarities, said transfer roller is an electrically conducting sponge roller that is brought into contact with the surface of the photosensitive material or is brought into pressed contact with the surface of the photosensitive material with a force which is not larger than 500 g/cm$^2$, a DC voltage applied to the transfer roller is of a polarity opposite to the polarity of the surface of the photosensitive material that is electrically charged by the main charger and has a value larger than a charge start voltage of the photosensitive material, and the potential on the surface of the photosensitive material after it is discharged is set to be not larger that 50 V in an absolute value.

7. An image-forming apparatus according to claim 6, wherein the transfer roller is impressed with a voltage which is 1.5 times or more as great as the charge start voltage.

8. An image-forming apparatus according to claim 6, wherein the transfer roller is made of a foamed polyurethane composition blended with an electrically conducting powder.

9. An image-forming apparatus employing a reversal developing system and comprising a photosensitive material, a main charger, an image-exposing device, a reversal developing device, a transfer device and a discharger, wherein the transfer device comprises a transfer roller disposed near the surface of the photosensitive material and a power source for applying a DC voltage to said transfer roller, and wherein said photosensitive material is an organic photosensitive material having a single dispersion type photosensitive layer formed on an electrically conducting substrate, and the photosensitive layer contains a charge-generating agent, an electron-transporting agent and a positive hole-transporting agent dispersed in a resin medium and has a charge start voltage of from 300 V to 2000 V and is capable of being electrically charged into both positive and negative polarities, said transfer roller is an electrically conducting sponge roller made of a foamed polyurethane composition blended with an electrically conducting powder that is brought into pressed contact with the surface of the photosensitive material with a force which is not larger than 500 g/cm$^2$, a DC voltage applied to the transfer roller is of a polarity opposite to the polarity of the surface of the photosensitive material that is electrically charged by the main charger and the transfer roller is impressed with a voltage which is 1.5 times or more as great as the charge start voltage of the photosensitive material, and the potential on the surface of the photosensitive material after it is discharged is set to be not larger than 50 V in an absolute value.

* * * * *